United States Patent [19]

Yabe et al.

[11] 4,265,946

[45] May 5, 1981

[54] PROCESS FOR FORMING A SUBBING LAYER ON A PLASTIC SUPPORT

[75] Inventors: Masao Yabe; Sumitaka Tatsuta; Takeji Ochiai; Tamotsu Suzuki, all of Fujinomiya; Masayoshi Sekiya, Tokyo, all of Japan

[73] Assignees: Fuji Photo Film Co., Ltd., Minami-ashigara; Nippon Zeon Co., Ltd., Tokyo, both of Japan

[21] Appl. No.: 93,468

[22] Filed: Nov. 13, 1979

[30] Foreign Application Priority Data

Nov. 13, 1978 [JP] Japan ..... 53/139581

[51] Int. Cl.[3] ..... B05D 3/02; G03C 1/78

[52] U.S. Cl. ..... 427/393.5; 427/412.5; 427/414; 430/531; 430/533; 430/534; 430/535

[58] Field of Search ..... 427/393.5, 412.5, 414; 430/531, 533, 534, 535

[56] References Cited

U.S. PATENT DOCUMENTS 3,615,556 10/1971 Clachan et al. ..... 430/534

OTHER PUBLICATIONS

Duggan et al., *Paper Technology* pp. 113–117, Aug. 1974.
Japan 037183 (4/10/76) Derwent Abstract.
Japan 042971 (15/10/76) Derwent Abstract.
Japan 047196 (27/10/76) Derwent Abstract.
Japan 063881 (01/12/76) Derwent Abstract.
Japan 045995 (23/10/76) Derwent Abstract.
Japan 142078 (30/5/77) Derwent Abstract.

*Primary Examiner*—Jack P. Brammer
*Attorney, Agent, or Firm*—Sughrue, Rothwell, Mion, Zinn and Macpeak

[57] ABSTRACT

A process for forming a subbing layer in photographic sensitive materials which comprises applying an aqueous dispersion of a copolymer consisting of at least one diolefin monomer and one or more vinyl monomers to a plastic film base in which the gel fraction of the copolymer in said aqueous dispersion is about 80% by weight or less.

14 Claims, No Drawings

PROCESS FOR FORMING A SUBBING LAYER ON A PLASTIC SUPPORT

BACKGROUND OF THE INVENTION

1. Field of the Invention

The present invention relates to a process for applying a subbing layer to a plastic film base prior to application of a photographic hydrophilic organic colloid layer (a photographic layer) such as a silver halide photographic emulsion layer, in order to firmly bond the photographic layer to the base.

2. Description of the Prior Art

Heretofore, two techniques have been used to firmly bond a photographic layer to a plastic film base, namely, (i) applying the photographic layer directly after carrying out a surface activation treatment such as chemical processing, an electric discharge treatment or an ultraviolet treatment, etc., and (ii) applying a subbing layer after surface activation and then applying the photographic layer thereto. These processes have been described in, for example, U.S. Pat. Nos. 2,698,241, 2,764,520, 2,864,755, 2,864,756 and 3,475,193 and British Pat. Nos. 788,365, 804,005 and 891,469. Of these processes, the process (ii) has been generally used. Particularly, when the base is polyethylene terephthalate (PET) or polystyrene, the photographic layer does not adhere sufficiently to the base if a subbing layer is not provided after carrying out the surface activation treatment.

The above-described surface activation treatment has the following shortcomings. Namely, when the surface of the base is treated with a solvent, the flatness of the base deteriorates and the residual solvent has a bad influence upon the photographic properties of the photographic layers, particularly, silver halide emulsion layers. Further, in order to obtain sufficient adhesion by the ultraviolet treatment, it is necessary to expose the base to a temperature higher than its glass transition temperature during the treatment and, consequently, its flatness deteriorates remarkably due to a lowering of the modulus of elasticity and contraction by heat, etc. If it is desired to obtain sufficient adhesion by corona discharge, the same result as with the above-described ultraviolet treatment occurs because the treatment similarly requires a high temperature higher than the glass transition temperature.

Moreover, surface activation sometimes not only deteriorates the quality of the support but also detrimentally influences the photographic layers by formation of a very small amount of oligomers or acetaldehyde, etc. Therefore, it has been desired to provide a process for subbing a photographic layer by which sufficient adhesion is obtained without surface activation or with as little surface activation. One technique for improving adhesion involves incorporating a solvent which swells or dissolves the base in the subbing solution. Salicyclic acid, trichloroacetic acid, pyrrole, chloral hydrate, phenol, p-chlorophenol, pyrogallol and resorcinol, etc., have been used as solvents for polyethylene terephthalate. These solvents, however, are generally difficult to handle and poisonous. Further, they endanger the environment and, consequently, their use requires care and is often subject to regulation.

The present inventors have studied a process for applying a subbing layer using an aqueous dispersion of a copolymer comprising (1) a diolefin monomer, (2) one or more vinyl monomers and, if necessary, (3) other components, as described in Japanese Patent Application (OPI) Nos. 112326/76 (The term "OPI" as used herein refers to a "published unexamined Japanese patent application"), Nos. 117617/76, 121323/76, 123139/76 and 139320/76. Further, the inventors have studied blending as described in Japanese patent application (OPI) No. 65422/77 and an addition process as described in British Pat. No. 1,532,517. While these processes improve adhesive strength to some degree without endangering the body or causing environmental problems, they require a considerable heat treatment after application and drying of the subbing layer in order to obtain sufficient adhesive strength and, consequently, they are disadvantageous from the viewpoint of operation and cost.

SUMMARY OF THE INVENTION

Accordingly, a first object of the present invention is to provide a process for application of a subbing layer by which the photographic layer firmly adheres to the support without application of a surface activation treatment.

A second object is to provide a process for applying a subbing layer using a subbing solution which is free from pollution problems and is not poisonous to the human body, by which the photographic layer firmly adheres to the base.

A third object is to provide a process for applying a subbing layer, by which sufficient adhesion is obtained even if processed at a comparatively low temperature.

A fourth object is to provide a process for applying a subbing layer, by which sufficient adhesion is obtained without damaging the flatness of the support.

A fifth object is to provide a subbing solution, by which sufficient adhesion is obtained without surface activation treatment even if processed at a comparatively low temperature, which is non-toxic and free from pollution and not a danger to public health.

A sixth object is to provide photographic sensitive materials having a subbing layer composed of the above-described subbing solution.

These objects of the present invention have been attained by applying an aqueous dispersion of a copolymer consisting of at least one diolefin monomer and one or more vinyl monomers to a plastic film base for photographic sensitive materials, characterized by the gel fraction of the copolymer in the aqueous dispersion being about 80% by weight or less.

DETAILED DESCRIPTION OF THE INVENTION

In the present invention, the diolefin monomer is a monomer having two ethylene bonds in the molecule and includes aliphatic unsaturated monomers ($C_4$–$C_{25}$) or alicyclic monomers ($C_8$–$C_{25}$). For example, there are butadiene, isoprene and chloroprene as conjugated dienes and 1,4-pentadiene, 1,4-hexadiene, 3-vinyl-1,5-hexadiene, 1,5-hexadiene, 3-methyl-1,5-hexadiene, 3,4-dimethyl-1,5-hexadiene, 1,2-divinylcyclobutane, 1,6-heptadiene, 3,5-diethyl-1,5-heptadiene, 4-cyclohexyl-1,6-heptadiene, 3-(4-pentenyl)-1-cyclopentene, 1,7-octadiene, 1,8-nonadiene, 1,9-decadiene, 1,9-octadecadiene, 1-cis-9-cis-12-octadecatriene, 1,10-undecadiene, 1,11-dodecadiene, 1,12-tridecadiene, 1,13-tetradecadiene, 1,14-pentadecadiene, 1,15-hexadecadiene, 1,17-octadecadiene and 1,21-docosadiene as non-conjugated dienes. Among these diolefin monomers, butadiene, isoprene and chloroprene as conjugated dienes are preferred and butadiene is particularly preferred.

As the vinyl monomers which are the second component of the copolymer used in the present invention, there are (i) styrene, acrylonitrile, methyl methacrylate, vinyl chloride, vinyl acetate and derivatives thereof and (ii) acrylic acid, methacrylic acid, itaconic acid, alkyl acrylates, acrylamide, methacrylamide, acrolein, methacrolein, glycidyl acrylate, glycidyl methacrylate, 2-hydroxyethyl acrylate, 2-hydroxyethyl methacrylate, allyl acrylate, allyl methacrylate, N-methylolated acrylamide, N-methylolated methacrylamide, divinylbenzene, vinyl isocyanate and allyl isocyanate, etc.

As the above-described styrene derivatives, there are, for example, methylstyrene, dimethylstyrene, ethylstyrene, diethylstyrene, isopropylstyrene, butylstyrene, hexylstyrene, cyclohexylstyrene, decylstyrene, benzylstyrene, chloromethylstyrene, trifluoromethylstyrene, ethoxymethylstyrene, acetoxymethylstyrene, methoxystyrene, 4-methoxy-3-methylstyrene, dimethoxystyrene, chlorostyrene, dichlorostyrene, trichlorostyrene, tetrachlorostyrene, pentachlorostyrene, bromostyrene, dibromostyrene, iodostyrene, fluorostyrene, trifluorostyrene, 2-bromo-4-trifluoromethylstyrene, 4-fluoro-3-trifluoromethylstyrene, vinylbenzoic acid and methyl vinylbenzoate, etc.

The copolymers of the present invention are composed of diolefin monomer-vinyl monomers. But it is particularly preferred that they are composed of the diolefin monomer and a vinyl monomer (i) above or the diolefin monomer, a vinyl monomer (i) above and a vinyl monomer (ii) above.

Particularly preferred copolymers include styrene-butadiene, styrene-isoprene, styrene-chloroprene, methyl methacrylate-butadiene and acrylonitrile-butadiene, etc.

It is preferred that the amount of the diolefin monomer in the copolymers of the present invention is about 10 to 60% by weight and particularly about 15 to 40% by weight based on the weight of the copolymer. The amount of the vinyl monomer is about 90 to 40% by weight based on the copolymer, but it is particularly preferred that the amount of vinyl monomer (i), particularly the styrenes is about 70 to 40% by weight based on the weight of the copolymer.

An important characteristic of the present invention is that the gel fraction of the copolymer in the aqueous dispersion is about 80% by weight or less.

Here, the term "gel" refers to the three-dimensionally polymerized state of the monomers. When the monomers in the composition as in the present invention are three-dimensionally polymerized, solubility varies with the degree of three-dimensional polymerization. Namely, the copolymer becomes more difficult to dissolve as the degree of three-dimensional polymerization increases.

Accordingly, the degree of three-dimensional polymerization is estimated by its solubility. Of course, since the solubility changes depending on the solvent used, the definition of the degree of three-dimensional polymerization of the gel varies. Accordingly, in the present invention, the gel state is defined with respect to the degree of three-dimensional polymerization such that the copolymer does not substantially dissolve when dipped in purified tetrahydrofuran at 20° C. for 48 hours.

Accordingly, the gel fraction in the present invention is calculated by the following formula.

$$\text{Gel fraction (\%)} = \frac{W_1 - W_2}{W_1} \times 100$$

Where $W_1$: Weight of the copolymer in the sample.

$W_2$: Measured by (1) drying a sample at 20° C. in vacuum, (2) immersing the sample in purified tetrahydrofuran for 48 hours at 20° C. and removing the solid sample by filtration, and (3) removing THF from the filtrate by evaporation and weighing the solid component obtained. Namely, $W_2$ is the weight of the component which dissolves in tetrahydrofuran.

Hitherto, it has been the common practice, in order to increase the adhesive strength, to increase cohesive force and film strength of the subbing layer, and techniques such as the addition of a cross-linking agent to the subbing solution have been utilized to this end. Considering these means in comparison with the present invention, one would naturally expect adhesive strength to increase at higher gel contents. However, it has been found that when the gel content of the polymer particles of the present invention is reduced to 80% by weight or less, sufficient adhesive strength is obtained even if the heat treatment is at a lower temperature than in the conventional processes. Particularly it is surprising that the adhesive strength between the support and the photographic layer according to the present invention is excellent even when the element is processed in a processing solution such as a developing solution.

The application of a subbing layer is generally divided into coating, drying and heat treatment. The effect of the improvement of adhesive strength resulting from the reduced gel fraction of the copolymer is notably shown in the drying step and the heat treatment step. If the gel fraction of the copolymer in the aqueous subbing solution (dispersion) is 80% by weight or less, a low water permeable subbing layer of high adhesion is easily formed. Namely, it is important that the gel fraction is 80% by weight or less in the range from the drying step to the heat treatment step.

Though it is the characteristic of the present invention that the gel fraction is, as described above, about 80% by weight or less, it is more advantageous that the gel fraction is about 40% by weight or less, because sufficient adhesive strength can be obtained by the heat treatment at a lower temperature. The lower limit of the gel fraction is not limited, however, from a practical standpoint it is about 10% by weight.

In the following, a process for preparing the aqueous dispersion of the copolymer according to the present invention is described. The aqueous dispersion of the copolymer consisting of at least one diolefin monomer and one or more vinyl monomers of the present invention can be prepared by, for example, a well known process for producing styrene-butadiene rubber (SBR) latexes. That is, it can be prepared by emulsion polymerization of the diolefin and the vinyl monomers in a presence of water, an emulsifier, a polymerization initiator and a polymerization regulator (a chain transfer agent), etc. As the emulsifier, there are, for example, aliphatic acid soaps and rhodinic acid soaps, etc. They are preferably used in an amount of about 0.1 to 5% by weight based on the polymerization system. As the polymerization initiator, peroxides, for example, $NaPO_4.10H_2O$, $K_2S_2O_8$, p-menthane hydroperoxide, $FeSO_4.7H_2O$ and EDTA tetrasodium salt, etc., can be used. Suitable polymerization regulators include primary and tertiary mercaptans having 6 to 18 carbon atoms such as t-dodecyl mercaptan, t-nonyl mercaptan and t-decyl mercaptan. The polymerization regulator is preferably used in an amount of about 0.05 to 2.0% by weight. The polymerization regulator may be present in the reactor prior to beginning the polymerization reaction or added little by little during the polymerization reaction.

Further, a polymerization inhibitor such as a hydroquinone or a dimethylcarbamate, etc., may be used in order to stop the polymerization reaction at a suitable stage. The polymerization inhibitor may be added after the polymerization reaction has proceeded to a suitable stage. It is preferably added in an amount of about 0.1% by weight based on the polymerization system.

The gel fraction of the copolymers used in the present invention can be adjusted by controlling the polymerization degree of the monomers. That is, the gel fraction can be adjusted by appropriately selecting the polymerization regulator and inhibitor and controlling their addition (i.e., time and amount) in a manner well known in the art.

For the process for preparing the aqueous dispersion of these copolymers according to the present invention reference can be made to, for example, *Goseigomu Gaisetsu* (*An outline of Synthetic Rubber*), pp. 39–59, written by Osami Asai (published by Asakura Shoten, 1971) and *Nippon Gomu Kyokaishi* (*Journal of the Society of Rubber Industry, Japan*), Vol. 50, No. 12, pp. 802–806 (1977).

After conclusion of the emulsion polymerization, unreacted monomers are removed, if necessary, and the aqueous dispersion of the copolymer according to the present invention is obtained. While the concentration of the copolymer as the solid component in the aqueous dispersion can be suitably determined, a concentration of about 10 to 60% by weight and particularly 30 to 50% by weight is preferred.

In order to apply the resulting aqueous dispersion as a subbing solution, the aqueous dispersion is diluted with water and, if necessary, a cross-linking agent, a surface active agent, a swelling agent, a hydrophilic polymer, a matting agent and an antistatic agent, etc., are added thereto. A preferred amount of the copolymer according to the present invention in the subbing solution is about 1 to 10% by weight and particularly about 2 to 5% by weight.

Suitable cross-linking agents include, for example, triazine compounds described in U.S. Pat. Nos. 3,325,287, 3,288,775 and 3,549,377 and Belgian Pat. No. 6,602,226, etc., dialdehyde compounds described in U.S. Pat. Nos. 3,291,624 and 3,232,764, French Pat. No. 1,543,694 and British Pat. No. 1,270,578, epoxy compounds described in U.S. Pat. No. 3,091,537 and Japanese Pat. No. 26580/74, vinyl compounds described in U.S. Pat. No. 3,642,486, aziridine compounds described in U.S. Pat. No. 3,392,024, ethyleneimine compounds described in U.S. Pat. No. 3,549,378, and methylol compounds. Among these cross-linking agents, 2,4-dichloro-6-hydroxy-s-triazine sodium salt is preferred. The cross-linking agent is used in an amount of about 0.001 to 10 g per liter of the subbing solution.

Though the swelling agent is generally not necessary, phenol or resorcinol may be added as the swelling agent in an amount of 1 to 10 g per liter of the subbing solution. The subbing layer of the present invention may also contain a hydrophilic polymer, and conventional additives such as a matting agent and an antistatic agent.

As the hydrophilic polymer, there are natural polymers such as gelatin and synthetic polymers such as polvyinyl alcohol, vinyl acetate-maleic acid anhydride copolymer, acrylic acid-acrylamide copolymer and styrenemaleic acid anhydride copolymer, etc., which are preferably used in an amount of about 0.05 to 5 g and particularly about 0.1 to 1 g.

As the matting agent, it is preferred to use silicon dioxide (silica), polystyrene or polymethyl methacrylate having a particle size of about 0.1 to 10μ.

As the antistatic agent, it is possible to use anionic or cationic surface active agents, ionic polymers, maleic acid copolymers described in U.S. Pat. No. 4,113,918 and colloidal silica (e.g., Snowtex, products by Nissan Chemicals Co.).

The subbing solution according to the present invention can be coated by well known methods, for example, dip coating, air knife coating, curtain coating, roller coating, wire bar coating, gravure coating or extrusion coating using a hopper described in U.S. Pat. No. 2,681,294. If necessary, it is possible to apply two or more layers at the same time by the methods described in, for example, U.S. Pat. Nos. 2,761,791, 3,508,947, 2,941,898 and 3,526,528 and *Coating Technology*, p. 253, written by Hitoshi Ozaki (published by Asakura Shoten, 1973).

The copolymer according to the present invention is preferably applied in an amount, as the solid content, of about 0.01 to 10 g and particularly about 0.2 to 3 g per aquare meter of the plastic base.

The applied subbing solution is then dried in the drying step at about 120° to 200° C. for about 30 seconds to 10 minutes. Temperature and time can be suitably selected within this range.

The plastic film base in the present invention are films of, for example, cellulose ester (particularly, cellulose triacetate, cellulose diacetate and cellulose propionate), polyamide, polycarbonate, polyester (particularly, polyethylene terephthalate, poly-1,4-cyclohexanedimethylene terephthalate and polyethylene-1,2-diphenoxyethane-4,4'-dicarboxylate), polystyrene, polypropylene or polyethylene, etc., and composite films prepared by coating or laminating bases such as paper with the above-described films.

Among them, the polyethylene terephthalate film is the most preferred. Particularly, a biaxially stretched heat set polyethylene terephthalate film is advantageously used from the viewpoint of its stability and stiffness, etc.

The thickness of the plastic film base is not especially limited. However, those which are about 15 to 500μ and particularly about 40 to 200μ thick are advantageously used because of their easy handling and various uses.

Further, the base may be transparent or may contain dyes or pigments such as titanium dioxide. Further, the base may contain silicon dioxide, alumina sol, chromium salts or zirconium salts, etc.

To the base on which a subbing layer is provided by the present invention, photographic layers are applied by conventional application methods to produce a photographic sensitive material.

Examples of the photographic layers include a silver halide emulsion layer, an intermediate layer, a filter layer, a surface protective layer and a backing layer, etc. These photographic layers contain hydrophilic colloids as a binder. Examples of the hydrophilic colloids include gelatin, phthalated gelatin, maleated gelatin, carboxymethyl cellulose, hydroxyethyl cellulose, grafted gelatin, polyvinyl alcohol, polyhydroxyalkyl acrylate, polyvinyl pyrrolidone, and copoly-vinyl pyrrolidone-vinyl acetate, etc. They may contain a dispersion of water-insoluble or slightly soluble synthetic polymers besides the above-described hydrophilic colloids. For example, it is possible to use polymers composed of one or more monomers selected from alkyl acrylate, alkyl methacrylate, alkoxyalkyl acrylate, alkoxyalkyl methacrylate, glycidyl acrylate, glycidyl methacrylate, acrylamide, acrylmethacrylamide, vinyl ester (for example, vinyl acetate), acrylonitrile, olefin and styrene, and polymers composed of a combination of the above-described monomers with acrylic acid, methacrylic acid, $\alpha,\beta$-unsaturated dicarboxylic acid, hydroxyalkyl acrylate, hydroxyalkyl methacrylate, sulfoalkyl acrylate, sulfoalkyl methacrylate or styrenesulfonic acid. For example, it is possible to use those described in U.S. Pat. Nos. 2,376,005, 2,739,137, 2,853,457, 3,062,674, 3,411,911, 3,488,708, 3,525,620, 3,607,290, 3,635,715 and 3,645,740 and British Pat. Nos. 1,186,699 and 1,307,373.

The photographic layers may contain, if necessary, silver halide particles, chemical sensitizers, antifogging agents, stabilizing agents, hardening agents, antistatic agents, application assistants, matting agents, whitening agents, spectrally sensitizing coloring matters, dyes and color couplers, etc.

These additives are described in *Research Disclosure,* Vol. 92, pp. 107–110 (Dec., 1971).

Below the present invention is illustrated in detail with reference to some specific examples. But the present invention is not limited to these examples.

In the examples, the adhesion test is carried out by the following method.

(1) Dry State Adhesion Test

The face of the emulsion layer of a green film and the face of the emulsion layer of a dry film after development are scratched using a razor to leave a crosswork of scratches at intervals of about 4 mm. Then an adhesive tape (Scotch Mending Tape, produced by Sumitomo 3M Co.) is allowed to adhere thereto and stripped off a moment later. In this test, area stripped off the film is observed and Grade A indicates that the peeled area was 0 to below 5%, Grade B indicates 5 to below 30% stripped off, and Grade C indicates the case of 30 to 100%.

(2) Wet State Adhesion Test

In each step of development, fixation and washing, the face of the emulsion layer of the film was scratched by a steel pen in each processing solution to leave two crossing scratch lines, and the scratching part is rubbed by the finger tip in a direction perpendicular to the line. Grade A indicates that the emulsion layer did not peel from the scratch lines, Grade B indicates that the maximum peeling width is 5 mm or less, and Grade C indicates that the maximum peeling width is 5 mm or more.

EXAMPLE 1

A subbing solution having the following composition was applied to a biaxially stretched crystallized polyethylene terephthalate film. It was then dried at 180° C. for 1 minute and subjected to heat treatment to obtain a subbing layer having 0.5$\mu$ dry thickness. To this base having the subbing layer, an X-ray sensitive silver halide emulsion (AgBrI, I: 2.5% by mol) was applied at a rate of 3 g silver and 3.5 g gelatin per square meter, and dried.

| SUbbing Composition (1) | |
|---|---|
| Butadiene-styrene copolymer latex (solid content: 50%, ratio by weight of butadiene/styrene = 40/60, and gel fraction: 38%) | 10 ml |
| 8% Aqueous solution of 2,4-dichloro-6-hydroxy-s-triazine sodium salt | 2 ml |
| Distilled water | 150 ml |

| Subbing Composition (2) | |
|---|---|
| Butadiene-styrene copolymer latex (solid content: 50%, ratio by weight of butadiene/styrene = 40/60, and gel fraction: 95%) | 10 ml |
| 8% Aqueous solution of 2,4-dichloro-6-hydroxy-s-triazine sodium salt | 2 ml |
| Distilled water | 150 ml |

The adhesive strength in the wet state in the resulting photographic sensitive film was Grade A in case of Subbing Composition (1) but Grade C in case of the Subbing Composition (2). The adhesive strength in the dry state was Grade A in both cases using the Subbing Composition (1) or (2). Further, photographic properties of the photographic film prepared by applying this emulsion were excellent in both cases using the Subbing Composition (1) or (2).

EXAMPLE 2

A subbing solution having the following composition was applied to a biaxially stretched crystallized polyethylene terephthalate film.

It was then dried at 170° C. for 1 minute and subjected to heat treatment to obtain a subbing layer having 0.5$\mu$ of the dry thickness. To the resulting base having the subbing layer, a silver halide emulsion for X-rays was applied in the same manner as in Example 1.

| Subbing Composition (3) | |
|---|---|
| Butadiene-styrene-2-ethylhexyl acrylate copolymer latex (solid content: 43%, ratio by weight of butadiene/styrene/2-ethylhexyl acrylate = 33/54/13, and gel content: 16%) | 10 ml |
| 2,4-Dichloro-6-hydroxy-s-triazine sodium salt (8% aqueous solution) | 2 ml |
| Distilled water | 150 ml |

| Subbing Composition (4) | |
|---|---|
| Butadiene-styrene-2-ethylhexyl acrylate copolymer latex (solid content: 43%, ratio by weight of butadiene/styrene/2-ethylhexyl acrylate = 33/54/13, and gel content: 16%) | 10 ml |
| 2,4-Dichloro-6-hydroxy-s-triazine sodium salt (8% aqueous solution) | 2 ml |
| Distilled water | 150 ml |

The adhesive strength in the wet state in the resulting photographic sensitive film was Grade A in case of using the Subbing Composition (3) but Grade B in case of using the Subbing Composition (4). The adhesive strength in the dry state was Grade A in both cases of using the Subbing Composition (3) or (4). Further, photographic properties of the photographic film prepared by applying this emulsion were excellent in both cases of using the Subbing Composition (3) or (4).

EXAMPLE 3

A subbing solution having the following composition was applied to a biaxially stretched crystallized polyethylene terephthalate film.

It was then dried at 170° C. for 1 minute and subjected to heat treatment to obtain a subbing layer having 0.5μ of the dry thickness. To the resulting base having the subbing layer, a silver halide emulsion for X-rays was applied by the same manner as in Example 1.

| Subbing Composition (5) | |
|---|---|
| Butadiene-styrene copolymer latex (solid content: 43%, ratio by weight of butadiene/styrene = 32/68, and gel fraction: 29%) | 10 ml |
| 2,4-Dichloro-6-hydroxy-s-triazine sodium salt (8% aqueous solution) | 2 ml |
| Distilled water | 150 ml |

| Subbing Composition (6) | |
|---|---|
| Butadiene-styrene copolymer latex (solid content: 43%, ratio by weight of butadiene/styrene = 32/68, and gel fraction: 57%) | 10 ml |
| 2,4-Dichloro-6-hydroxy-s-triazine sodium salt (8% aqueous solution) | 2 ml |
| Distilled water | 150 ml |

The adhesive strength in the wet state in the resulting photographic sensitive film was Grade A in the case of using the Subbing Composition (5) but Grade B in the case of using the Subbing Composition (6). The adhesive strength in the dry state was Grade A in both cases of using the Subbing Composition (5) or (6). Further, photographic properties of the photographic film prepared by applying this emulsion were excellent in both cases of using the Subbing Composition (5) or (6).

While the invention has been described in detail and with reference to specific embodiments thereof, it will be apparent to one skilled in the art that various changes and modifications can be made therein without departing from the spirit and scope thereof.

What is claimed is:

1. In a process for forming a subbing layer by applying an aqueous dispersion of a copolymer consisting of at least one diolefin monomer and one or more vinyl monomers to a plastic film base for photographic sensitive materials, the improvement which comprises the gel fraction of the copolymer in said aqueous dispersion is about 80% by weight or less and wherein said diolefin is selected from the group consisting of butadiene, isoprene, chloroprene, 1,4-pentadiene, 1,4-hexadiene, 3-vinyl-1,5-hexadiene, 1,5-hexadiene, 3-methyl-1,5-hexadiene, 3,4-dimethyl-1,5-hexadiene, 1,2-divinylcyclobutane, 1,6-heptadiene, 3,5-diethyl-1,5-heptadiene, 4-cyclohexyl-1,6-heptadiene, 3-(4-pentenyl)-1-cyclopentene, 1,7-octadiene, 1,8-nonadiene, 1,9-decadiene, 1,9-octadecadiene, 1-cis-9-cis 12-octadecatriene, 1,10-undecadiene, 1,11-dodecadiene, 1,12-tridecadiene, 1,13-tetradecadiene, 1,14-pentadecadiene, 1,15-hexadecadiene, 1,17-octadecadiene and 1,21-docosadiene and wherein said vinyl monomer is selected from the group consisting of styrene and derivatives thereof, acrylonitrile, methyl methacrylate, vinyl chloride, vinyl acetate, acrylic acid, methacrylic acid, itaconic acid, alkyl acrylates, acrylamide, methacrylamide, acrolein, methacrolein, glycidyl acrylate, glycidyl methacrylate, 2-hydroxyethyl acrylate, 3-hydroxyethyl methacrylate, allyl acrylate, allyl methacrylate, N-methylolated acrylamide, N-methylolated methacrylamide, divinylbenzene, vinyl isocyanate and allyl isocyanate.

2. The process of claim 1, wherein said gel fraction is about 40% by weight or less.

3. The process of claim 1, wherein said diolefin is selected from the group consisting of butadiene, isoprene and chloroprene.

4. The process of claim 1, wherein said diolefin is butadiene.

5. The process of claim 3, wherein said copolymer is a copolymer of said diolefin and at least one monomer selected from the group consisting of styrene and derivatives thereof, acrylonitrile, methylmethacrylate, vinyl chloride and vinyl acetate.

6. The process of claim 1, wherein said copolymer is a copolymer of a diolefin and (i) at least one monomer selected from the group consisting of styrene and derivatives thereof, acrylonitrile, methyl methacrylate, vinyl chloride and vinyl acetate and (ii) at least one monomer selected from the group consisting of acrylic acid, methacrylic acid, itaconic acid, alkyl acrylates, acrylamide, methacrylamide, acrolein, methacrolein, glycidyl acrylate, glycidyl methacrylate, 2-hydroxyethyl acrylate, 2-hydroxyethyl methacrylate, allyl acrylate, allyl methacrylate, N-methylolated acrylamide, N-methylolated methacrylamide, divinylbenzane, vinyl isocyanate and allyl isocyanate.

7. The process of claim 1, wherein said copolymer is a styrene-butadiene copolymer, a styrene-isoprene copolymer, a styrene-chloroprene copolymer, a methyl methacrylate-butadiene copolymer or an acrylonitrilebutadiene copolymer.

8. The process of claim 1, wherein said diolefin is present in said copolymer in an amount of about 10 to 60% by weight.

9. The process of claim 1, wherein said vinyl monomer is present in said copolymer in an amount of about 90 to 40% by weight.

10. The process of claim 9, wherein at least about 70 to 40% by weight of said copolymer is selected from the group consisting of styrene and derivatives thereof, acrylonitrile, methyl methacrylate, vinyl chloride and vinyl acetate.

11. The process of claim 1, wherein said copolymer is a butadiene-styrene copolymer.

12. The process of claim 1, wherein said copolymer is a butadiene-styrene-2-ethylhexyl acrylate copolymer.

13. The process of claim 1, wherein said copolymer has a gel fraction of at least about 10% by weight.

14. The process of claim 1, wherein said aqueous dispersion of a copolymer further comprises a cross-linking agent.

* * * * *